US006415713B1

(12) United States Patent
Abrams

(10) Patent No.: US 6,415,713 B1
(45) Date of Patent: Jul. 9, 2002

(54) RIGID LINER FOR A YARD REFUSE BAG

(76) Inventor: Howard Abrams, 64 Timothy Dr., Ivyland, PA (US) 18974

( * ) Notice: Subject to any disclaimer, the term of this patent is extended or adjusted under 35 U.S.C. 154(b) by 0 days.

(21) Appl. No.: 09/507,847

(22) Filed: Feb. 22, 2000

(51) Int. Cl.[7] ..... B30B 5/00

(52) U.S. Cl. ..... 100/246; 100/247; 100/265; 100/90; 248/97; 248/99

(58) Field of Search ..... 100/265, 229 A, 100/246, 247; 248/97, 98, 99; 141/390, 391; 220/403

(56) References Cited

U.S. PATENT DOCUMENTS

| | | | | | |
|---|---|---|---|---|---|
| 576,782 | A | | 2/1897 | Goodrich | |
| 579,228 | A | | 3/1897 | Frame | |
| 645,544 | A | | 3/1900 | Bissell | |
| 1,503,183 | A | * | 7/1924 | Bailey | 100/247 |
| 1,668,053 | A | | 5/1928 | Dawson | |
| 2,172,529 | A | | 9/1939 | Barker et al. | |
| 3,722,561 | A | | 3/1973 | O'Leary et al. | |
| 3,822,524 | A | | 7/1974 | Jerpbak | |
| 3,863,563 | A | * | 2/1975 | Popeil | 100/265 |
| 3,936,087 | A | | 2/1976 | Alexander | |
| 4,037,778 | A | | 7/1977 | Boyle | |
| 4,268,081 | A | | 5/1981 | Hawkinson | |
| 4,530,533 | A | | 7/1985 | Dieter | |
| 4,643,380 | A | * | 2/1987 | Copeland | 248/97 |
| 4,697,771 | A | * | 10/1987 | Majors | 248/97 |
| 4,749,011 | A | | 6/1988 | Rylander | |
| 4,760,982 | A | | 8/1988 | Cooke | |
| 4,832,292 | A | | 5/1989 | Beckham | |
| 4,890,652 | A | | 1/1990 | Hoerner | |
| 4,979,547 | A | | 12/1990 | Hoerner | |
| 5,065,965 | A | | 11/1991 | Aulabaugh | |
| 5,129,609 | A | | 7/1992 | Tobin | |
| 5,180,125 | A | | 1/1993 | Caveney | |
| 5,226,554 | A | | 7/1993 | Dauphinais | |
| 5,271,589 | A | | 12/1993 | Belous | |
| 5,316,060 | A | | 5/1994 | Hodgdon et al. | |
| 5,358,138 | A | * | 10/1994 | Karwoski | 220/403 |
| 5,393,022 | A | | 2/1995 | Palumbo | |
| 5,593,117 | A | | 1/1997 | Alexander, III | |
| 5,597,022 | A | | 1/1997 | Reifers | |
| 5,716,033 | A | | 2/1998 | Gibson | |
| 5,797,314 | A | * | 8/1998 | Hendrick | 100/265 |
| 5,806,416 | A | * | 9/1998 | Cernilia et al. | 100/246 |
| 5,897,084 | A | | 4/1999 | Judge | |
| 6,085,647 | A | * | 7/2000 | Burow | 100/265 |
| 6,109,002 | A | * | 8/2000 | McCabe | 248/99 |

* cited by examiner

*Primary Examiner*—Stephen F. Gerrity
*Assistant Examiner*—Louis Huynh
(74) *Attorney, Agent, or Firm*—Caesar, Rivise, Bernstein, Cohen & Pokotilow, Ltd.

(57) ABSTRACT

A rigid yard refuse bag liner for insertion into a yard refuse bag for supporting the yard refuse bag in an open condition. The rigid yard refuse bag liner is an elongated enclosure having an open bottom and having a tapered construction such that its bottom portion is wider than its top portion, which facilitates the removal of the rigid liner once the refuse bag liner/refuse bag are filled with yard refuse. To further facilitate this removal, air vents running through the enclosure permit the passage of air as the rigid liner is lifted upward, out of the yard bag. A compactor is associated with the rigid liner whereby the compactor is a planar surface coupled to a handle that the user can grasp and apply pressure to in order to compact the yard refuse that has already been collected.

19 Claims, 2 Drawing Sheets

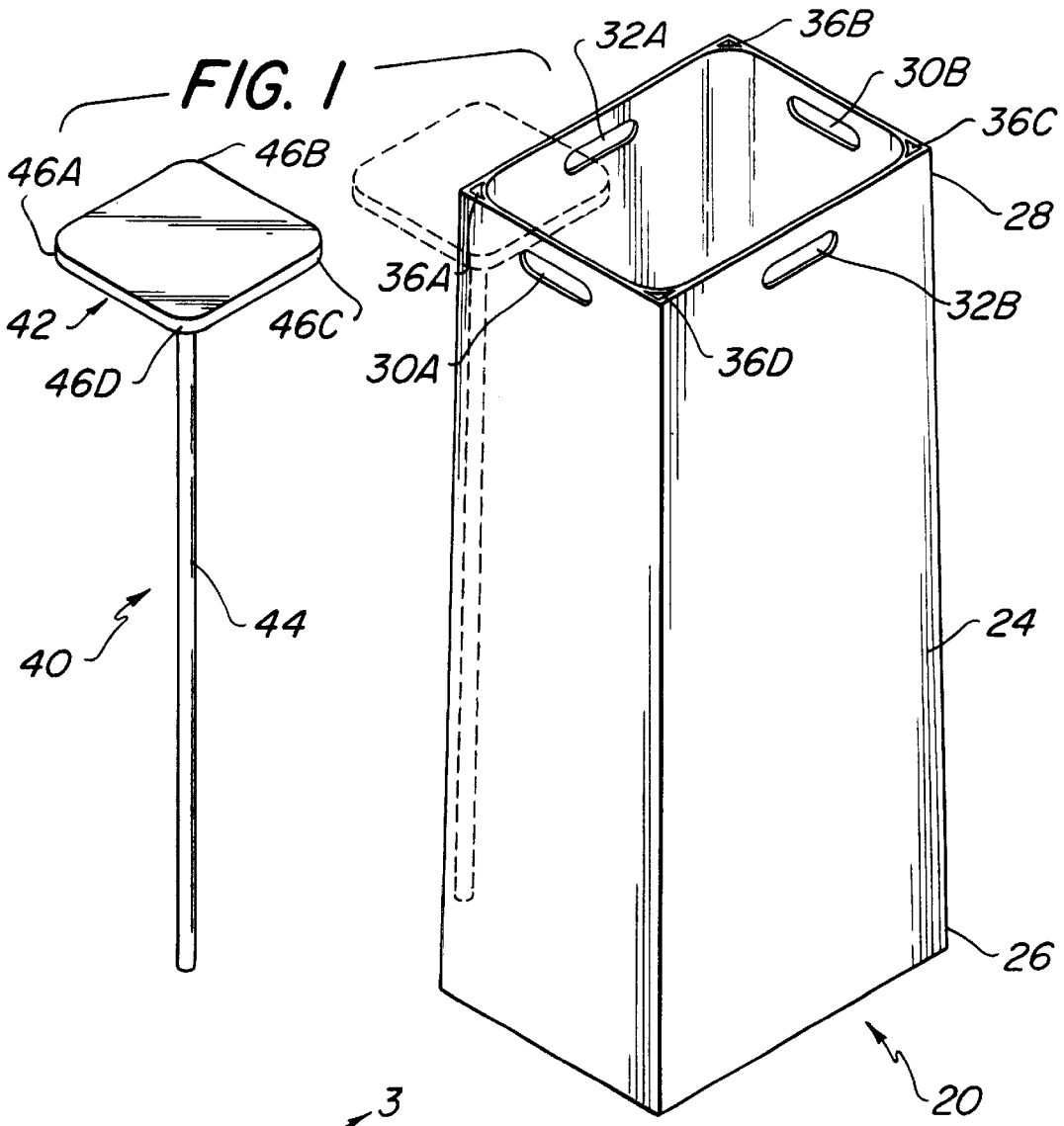
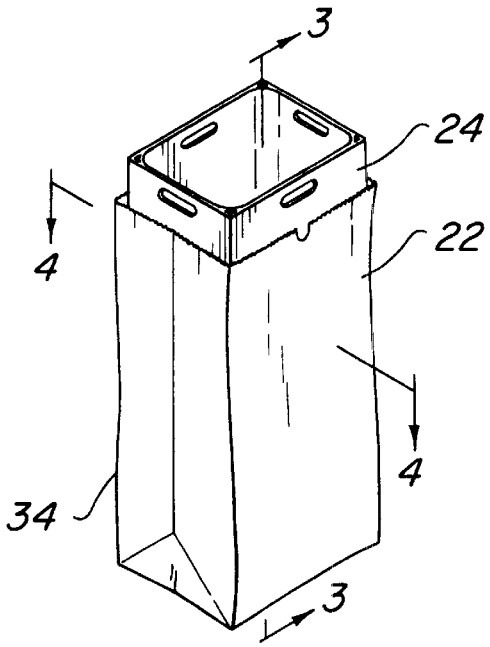
FIG. 2

RIGID LINER FOR A YARD REFUSE BAG

FIELD OF THE INVENTION

The invention pertains to devices for supporting trash bags during filling, and more particularly, to devices for filling yard refuse bags for re-cycling purposes.

BACKGROUND OF INVENTION

Many townships require residents to separate yard refuse from other trash that is set out for scheduled pick-up by placing the yard refuse in specially-designated yard refuse bags. These yard refuse bags consist of heavy paper and are rectangular in shape, much like a large shopping bag.

However, in order to fill these bags many problems occur. For example, since the yard refuse bag consists of paper, there is no support, other than the heavy paper structure to maintain in it an open position. In addition, when the person begins filling the bag and attempts to compact the collected contents, the shape of the bag becomes distorted, causing it to fall over and/or causing any compacted twigs, branches, etc. to tear or rip the bag during the filling. If the user wants to avoid this, the user may simply not fill the entire bag, but rather just obtain another bag, thereby not getting the full use of the yard refuse bag which is wasteful.

The following patents are examples of attempts to solve some of the above problems but suffer from one or more other problems discussed below.

U.S. Pat. Nos. 4,890,652/ 4,979,5471/(Hoemer) disclose a collapsible trash bag support sleeve. However, the sleeve suffers from a number of problems such as failure to retain a rectangular shape during filling, thereby stressing the bag which tends to rip it. Furthermore, the trash bag's upper portion must be secured in anchoring slits that tend to rip the trash bag during filling. In addition, despite the use of firm panels, the overall sleeve may tend to twist and deform; this distortion not only makes it difficult to release the sleeve from the trash bag (once the bag is filled), but it also tends to rip/tear the trash bag. In addition, the use of adhesives, or other closure means, to form the rectangular sleeve tends to wear after much use, which further aggravates the tendency to distort the sleeve shape. Should the closure means disengage, the yard refuse is then exposed to the trash bag, thereby defeating the purpose of the sleeve. See also U.S. Pat. Nos. 4,037,778 (Boyle); 5,897,084 (Judge).

U.S. Pat. No. 5,597,022 (Reifers) discloses a device for loading trash bags. However, this device is meant for particular use with a conventional plastic trash bag and would, most likely, tear or rip a yard refuse bag due to the latter's rectangular construction and the bag engagement mechanism at the top of the device. Furthermore, the device requires that the user frequently lift the device/bag as it is filled in different stages in order to force collected yard refuse down inside the bag.

U.S. Pat. No. 3,722,561 (O'Leary et al.) discloses a support for a flexible container. However, this support suffers from, among other things, a slit that can expose the refuse to the trash bag directly. In addition, this support is designed for a small, in-house trash container, not a large yard refuse bag.

Other trash bag support devices are shown in the following U.S. patents, namely, U.S. Pat. No. 576,782 (Goodrich); U.S. Pat. No. 579,228 (Frame); U.S. Pat. No. 645,544 (Bissell); U.S. Pat. No. 1,668,053 (Dawson); U.S. Pat. No. 2,172,529 (Barker et al.); U.S. Pat. No. 3,822,524 (Jerpbak); U.S. Pat. No. 3,936,087 (Alexander); U.S. Pat. No. 4,268, 081 (Hawkinson); U.S. Pat. No. 4,749,011(Rylander); U.S. Pat. No. 4,530,533 (Dieter); U.S. Pat. No. 4,760,982 (Cooke); U.S. Pat. No. 4,832,292 (Beckham); U.S. Pat. No. 5,065,965 (Aulabaugh); U.S. Pat. No. 5,129,609 (Tobin); U.S. Pat. No. 5,180,125 (Caveney); U.S. Pat. No. 5,226,554 (Dauphinais); U.S. Pat. No. 5,271,589 (Belous); U.S. Pat. No. 5,316,060 (Hodgon et al.); U.S. Pat. No. 5,393,022 (Palumbo); U.S. Pat. No. 5,593,117 (Alexander, III); U.S. Pat. No. 5,716,033 (Gibson);

However, none of these references appear to teach or suggest the use of a rigid liner inside a yard refuse bag that not only prevents the tearing/ripping of the yard bag during filling, but remains stable throughout the filling and removal operation, while providing features that facilitate the removal of the liner from the yard refuse bag after filling.

OBJECTS OF THE INVENTION

Accordingly, it is the general object of this invention to provide overcomes the disadvantages of the prior art.

It is an object of the present invention to provide an apparatus for facilitating the filling of a yard refuse bag by controlling the balance of the yard bag.

It is still yet another object of the present invention to provide an apparatus for facilitating the filling of a yard refuse bag by preventing the ripping/tearing of the yard bag during filling of the yard bag.

It is still yet another object of the present invention to provide an apparatus for facilitating the filling of a yard refuse bag by permitting increased pressure to be applied to the yard refuse, already in the yard bag, in order to compact it, thereby permitting more yard refuse to be collected into the yard bag without ripping/tearing it.

It is even yet another object of the present invention to provide an apparatus for facilitating the filling of a yard refuse bag that can be more easily removed from the yard bag by utilizing a tapered construction.

It is still yet even a further object of the present invention to provide an apparatus for facilitating the filling of a yard refuse bag that can be more easily removed from the yard bag using air vents in the apparatus.

It is still yet another object of the present invention to provide an apparatus for facilitating the filling of a yard refuse bag that utilizes rounded interior corners to minimize lodging of the yard refuse in the apparatus.

It is still yet another object of the present invention to provide an apparatus for facilitating the filling of a yard refuse bag that utilizes an associated compactor for compacting already-collected yard refuse to make room for more yard refuse.

SUMMARY OF THE INVENTION

These and other objects of the instant invention are achieved by providing an apparatus for facilitating the collection of yard refuse (e.g., dry leaves, twigs, branches, trimmed shrubbery, or any other waste designated by local ordinances to be "yard waste sufficient for re-cycling") into a yard refuse bag. The apparatus comprises an elongated rigid enclosure having an open bottom wherein the apparatus is adapted to be positioned inside the yard refuse bag.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is an isometric view showing the rigid yard bag liner and a manual compactor;

FIG. 2 is an isometric view showing the rigid yard bag liner partially disposed inside a yard refuse bag;

DETAILED DESCRIPTION OF THE PREFERRED EMBODIMENT

Figure 3:
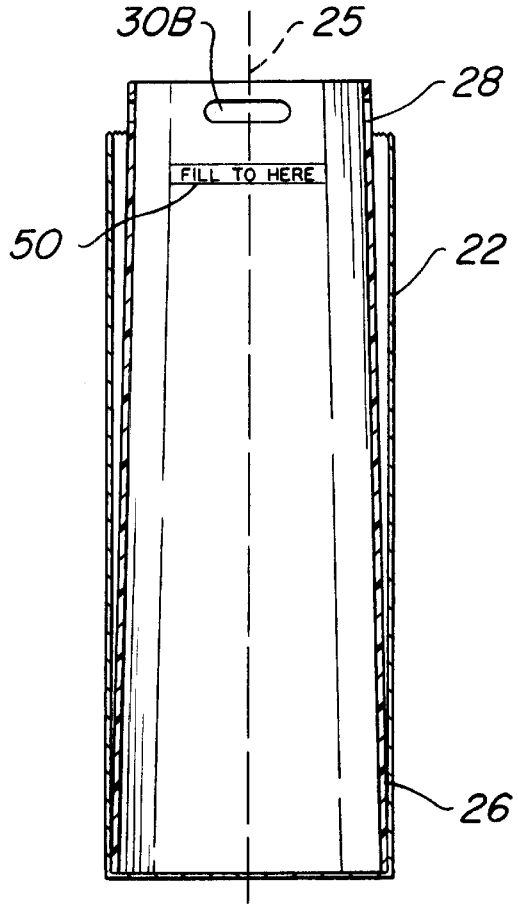
FIG. 3 is a cross-sectional view of the rigid yard bag liner and yard bag taken along line 3—3 of FIG. 2.

Referring now in detail to the various figures of the drawing wherein like reference characters refer to like parts, there is shown at 20, a rigid yard refuse bag liner for use with a yard refuse bag to facilitate the collection of yard refuse (e.g., dry leaves, twigs, branches, trimmed shrubbery, or any other waste designated by local ordinances to be. "yard waste sufficient for recycling") into a yard refuse bag 22.

The liner 20 comprises a rigid elongated enclosure 24 comprising a one-piece molded construction, of any durable material, e.g., polyethylene, PVC (poly vinyl chloride) including polymers, other plastic materials including recyclable plastics and other plastic compounds. The enclosure 24 has no bottom surface (see FIG. 4) in order to permit the liner 20 to be removed from the yard refuse bag 22, once the enclosure 24/yard refuse bag 22 is filled up.

It should be understood that the term "rigid" as used in this patent application defines that the enclosure is of a non-collapsible construction, i.e., it cannot be disassembled and/or folded up.

To facilitate the removal of the liner 20 once the enclosure 24/yard refuse bag 22 are filled up, the enclosure 24 comprises a tapered construction, i.e., the bottom portion 26 is wider than the top portion 28, with reference to a longitudinal axis 25, FIG. 3. In particular, once the enclosure 24/yard refuse bag 22 is filled up, as the user pulls the enclosure 24 upward using any pair of handles 30A/30B or 32A/32B out of the yard bag 22, the bottom portion 26 of the enclosure is able to slide over the yard refuse (not shown), thereby releasing it into the lower portion 34 of the yard bag 22, while forcing yard refuse in the upper portion 28 of the enclosure 24 downward through the enclosure 24 and finally out into the yard bag 22. In addition, the tapered construction of the enclosure 24 also stabilizes the enclosure 24/yard bag 22 by providing a lower portion 26 base that is wider than the top portion 28.

To further facilitate the removal of enclosure 24 from the yard bag 22, air vents 36A–36D are positioned in the enclosure 24. In the preferred embodiment, where the enclosure 24 is a four-sided enclosure, these vents 36A–36D are located in the four corners of enclosure 24. These vents 36A–36D, running the length of the enclosure 24, permit trapped air to escape when the enclosure 24 is being lifted out of the yard bag 22.

It should be understood that these air vents 36A–36D could be located in the sides of the enclosure 24 also and are not restricted to being located in the corners of the enclosure 24.

Within the enclosure 24, the corners 38A–38D are rounded. This minimizes yard refuse, such as twigs or branches, getting lodged in the corners of the enclosure 24 which would occur if square corners were used.

Figure 4:
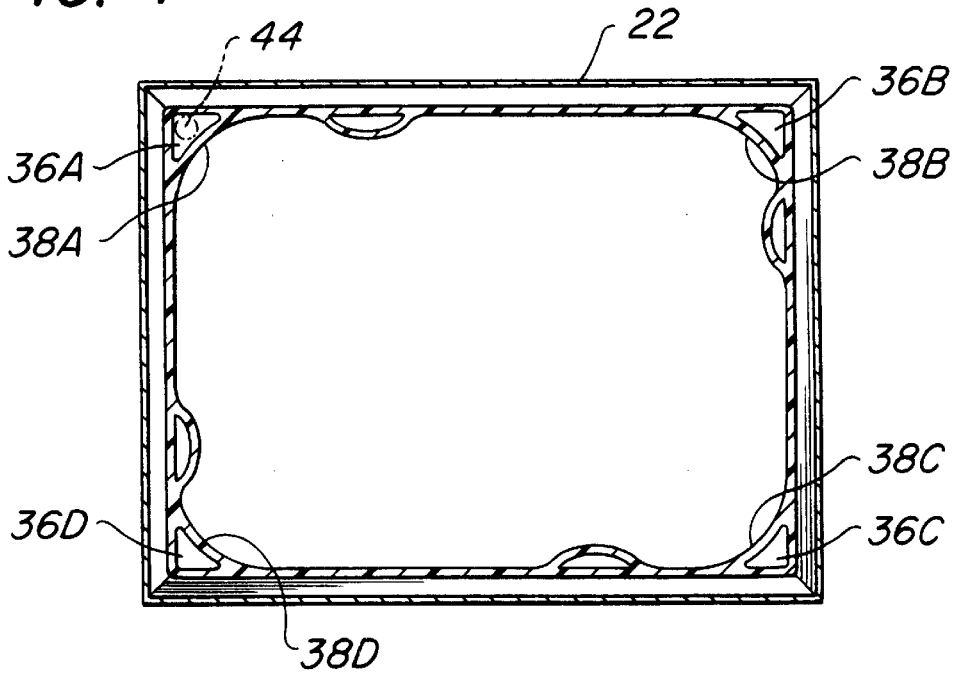
FIG. 4 is a cross-sectional view of the rigid yard bag liner and yard bag taken along line 4—4 of FIG. 2.

Associated with the rigid enclosure 24 is a compactor 40. The compactor 40 comprises a planar surface 42 and a handle 44. The planar surface 42 also comprises rounded corners 46A–46D that correspond to the rounded comers 38A–38D. As the enclosure 24/yard refuse bag 22 begins to fill up, the user grasps the compactor 40 with the handle 44 and applies pressure against the yard refuse with the planar surface 42 to compact the yard refuse in the enclosure 24/yard refuse bag 22. To maximize the compacting of yard refuse in the corners 38A–38D of the enclosure 24, the user can align one of the rounded corners 46A–46D with one of the comers 38A–38D and press downward, thereby compacting yard refuse located in the particular corner of the enclosure 24. Furthermore, during non-use, the compactor 40 can be stowed in the enclosure 24 by positioning the handle 44 into one of the air vents; e.g., as shown in FIG. 4, the handle 44 is stowed in air vent 36A.

To use the liner 20, the user opens a yard refuse bag 22 and then inserts the enclosure 24 into the bag's 22 interior. The user then throws yard refuse into the interior is of the enclosure 24. As filling occurs, the user can use the compactor 40 to compact the already-collected yard refuse, thereby making more room for more yard refuse. Furthermore, since the force of the compacting is distributed into the walls of the enclosure 24 only, and not into the yard bag 22, the usual risk of tearing/ripping the bag during compacting is avoided. When the height of the yard refuse reaches a designated height, which may be indicated by a line or other indicia 50 (FIG. 3), the user grasps one of the pairs of handles (30A/30B or 32A/32B) and lifts the enclosure 24 out of the yard bag 22.

The yard refuse bags 22 are typically heavy paper bags that are approximately 32 inches in length by approximately 16 inches in width. Although the preferred embodiment liner 20 is designed for use with such yard refuse bags 22, it is within the broadest scope of this invention to include other types of trash bags (e.g., plastic trash bags). When using a plastic trash bag with the liner 20, the upper portion of the trash bag can be passed through an opposing pair of handles (30A/30B or 32A/32B) and then knotted.

Without further elaboration, the foregoing will so fully illustrate my invention that others may, by applying current or future knowledge, readily adopt the same for use under various conditions of service.

I claim:

1. An apparatus for facilitating the collection of yard refuse into a yard refuse bag, said apparatus comprising an elongated rigid enclosure having an open bottom and open top, said elongated rigid enclosure comprising sides and a plurality of air vents, each of said air vents forming a continuous passageway contained in a corner joining two adjacent sides or contained in a side, said continuous passageway having an opening disposed in said open top and an opening disposed in said open bottom of said elongated rigid enclosure, said apparatus being adapted to be positioned inside the yard refuse bag and for supporting the yard refuse bag along its length during filling.

2. The apparatus of claim 1 wherein said elongated rigid enclosure is tapered along a longitudinal axis such that the bottom of said enclosure is wider than the top of said enclosure.

3. The apparatus of claim 1 wherein said air vents are aligned with a longitudinal axis of said enclosure.

4. The apparatus of claim 1 wherein said enclosure comprises at least two apertures near the top of said enclosure to form handles.

5. The apparatus of claim 1 wherein said rigid elongated enclosure comprises plastic.

6. The apparatus of claim 5 wherein said plastic is polyethylene.

7. The apparatus of claim 5 wherein said plastic is poly vinyl chloride.

8. The apparatus of claim 1 wherein said enclosure comprises four sides.

9. The apparatus of claim 8 wherein said elongated rigid enclosure is tapered along a longitudinal axis such that the bottom of said enclosure is wider than the top of said enclosure.

10. The apparatus of claim 9 wherein said air vents are aligned with a longitudinal axis of said enclosure.

11. The apparatus of claim 10 wherein said air vents are positioned in each corner of said enclosure.

12. The apparatus of claim 11 wherein each of said corners are rounded inside said enclosure.

13. The apparatus of claim 12 further comprising a compactor associated with said enclosure, said compactor comprising a planar surface coupled to a handle, said handle being used by a person to grasp said compactor and for applying pressure with said planar surface against yard refuse disposed in the yard bag to compact the yard refuse.

14. The apparatus of claim 13 wherein said handle is adapted to be stowed in any of said air vents.

15. The apparatus of claim 13 wherein said planar surface comprises rounded corners similar to said rounded corners inside said enclosure.

16. The apparatus of claim 8 wherein said enclosure comprises at least two apertures on opposite sides of the enclosure to form handles.

17. The apparatus of claim 8 wherein said rigid elongated enclosure comprises plastic.

18. The apparatus of claim 17 wherein said plastic is polyethylene.

19. The apparatus of claim 17 wherein said plastic is poly vinyl chloride.

* * * * *